United States Patent [19]

Fichte et al.

[11] 4,245,830

[45] Jan. 20, 1981

[54] CORRECTION OF TRANSVERSE OFFSET OF SHEETS IN SHEET FEEDING UNIT

[75] Inventors: Frank Fichte, Taucha; Wolfgang Paul, Leipzig, both of German Democratic Rep.

[73] Assignee: VEB Polygraph Leipzig Kombinat fuer Polygraphische Maschinen und Ausruestungen, Leipzig, German Democratic Rep.

[21] Appl. No.: 888,152

[22] Filed: Mar. 16, 1978

Related U.S. Application Data

[63] Continuation-in-part of Ser. No. 884,631, Mar. 6, 1978.

[30] Foreign Application Priority Data

Mar. 4, 1977 [DD] German Democratic Rep. ... 197667

[51] Int. Cl.[3] ..... B65H 1/22

[52] U.S. Cl. ..... 271/164

[58] Field of Search ..... 271/164, 147, 154, 155, 271/31, 162

[56] References Cited

U.S. PATENT DOCUMENTS

| | | | |
|---|---|---|---|
| 1,948,001 | 2/1934 | Mensman | 271/164 |
| 2,636,692 | 4/1953 | Picking | 226/119 X |
| 3,504,835 | 4/1970 | Callan | 226/23 |

*Primary Examiner*—Richard A. Schacher

*Attorney, Agent, or Firm*—Michael J. Striker

[57] ABSTRACT

A sheet feeding unit includes a stack elevator which raises the top of a supported stack of sheets to infeed height. A sensor senses the position of the top sheets of the stack, to ascertain whether these exhibit improper left or right offset. Depending upon the magnitude and size of the sensed offset, the stack elevator is correctively shifted, to minimize offset at the top of the stack. Although the sensor is located to only one side of the stack, not at both sides of the stack, it is capable of sensing offset in both left and right directions. When the elevator is lowered, for the laying in of a fresh stack, it is automatically brought to a centered position.

12 Claims, 8 Drawing Figures

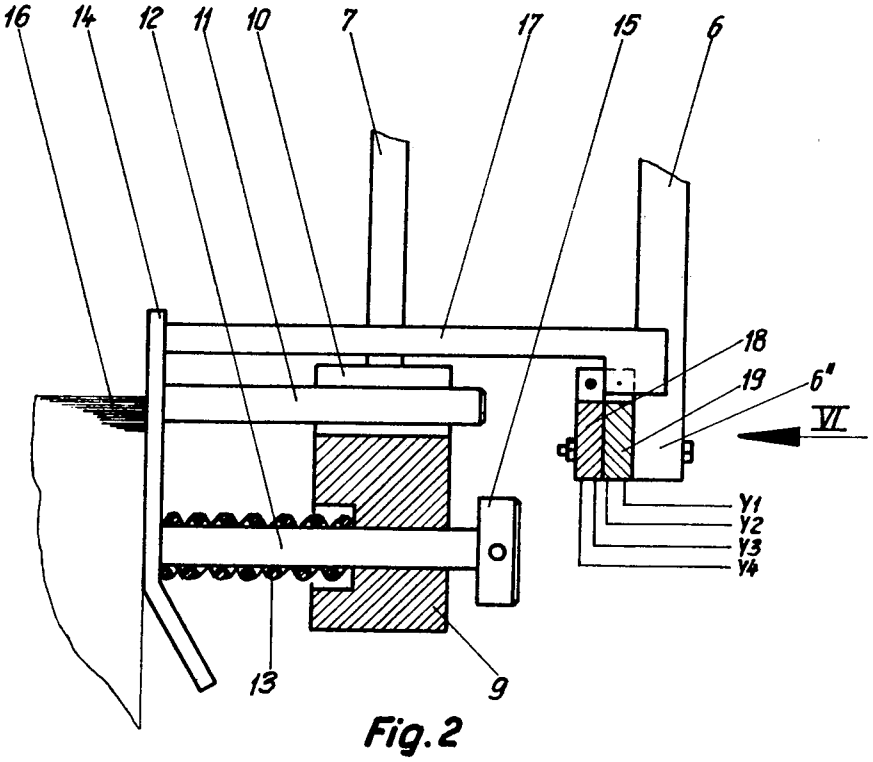
Fig. 2
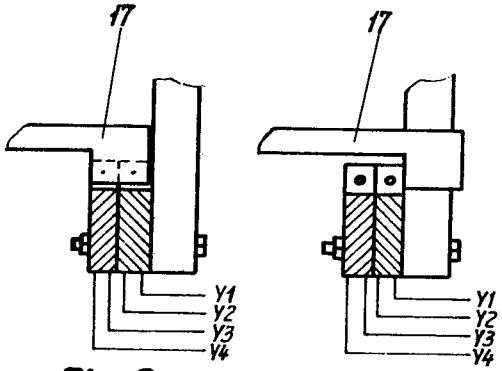
Fig. 3
Fig. 4
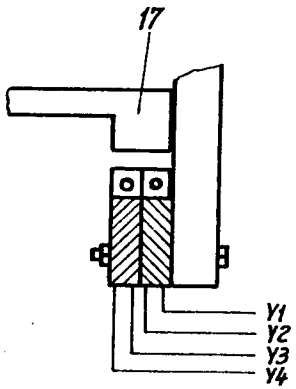
Fig. 5

CORRECTION OF TRANSVERSE OFFSET OF SHEETS IN SHEET FEEDING UNIT

This application is a continuation-in-part application of application Ser. No.: 884,631, filed Mar. 6, 1978.

BACKGROUND OF THE INVENTION

The present invention relates to sheet feeding units, such as feed sheets to printing machines or the like, and of the type including a stack elevator operative for raising the top of a stack of sheets to infeed height.

With such sheet feeding units, it is important that the sheets fed into the cooperating machine be fed in without excessive offset in the direction transverse to the infeed direction. However, this condition is not always easy to achieve. For example, if a very tall stack of sheets is laid onto the stack elevator, and its left and right side faces are markedly non-flat, e.g., convex or concave or wavy, it is not simple to force the side faces of so tall a stack of sheets into a flat, and therefore transversely aligned, condition.

German patent DT-PS No. 2,200,755 discloses a system for automatically eliminating transverse offset in the positioning of the sheets of the stack. That system includes two sensors, each located near the top of the stack, but at different respective sides of the stack, i.e., one at the left side of the stack, the other at the right side of the track. Each sensor is operative for sensing the position of the top sheets at its respective side of the stack, and in particular for determining whether the top sheets at its side of the stack are offset in a single respective direction. Each sensor cooperates with a respective switch. Depending upon which of the two switches is activated, a positioning motor shifts the stack elevator in one or the other direction, so as to correct the position of the top sheets.

However, the use of two cooperating sensors, each located at one side of the stack, and each operative for sensing offset in only one direction, brings about considerable practical inconvenience, with respect to servicing, setting-up, adjustment and tolerances. Firstly, the stack, when laid onto the elevator, must already be quite near a condition of no offset; otherwise, when the stack is raised at high speed to operative height, the top face of the stack will hit one or the other sensor from below, and either damage it or render it inoperative for signal generation so long as it rests on the top of the stack. Thus, after the stack has been laid on the elevator, a certain amount of manual work must be done, to bring the stack as much as possible into a correct position of no transverse offset, i.e., precisely that which the automatic offset-correction system should spare the operator from doing. Furthermore, the operator must adjust the settings of the two sensors with an inconvenient amount of carefulness and precision, in dependence upon sheet format (size). If the two sensors are set somewhat too close to each other, the negative-feedback offset-correction system becomes inoperative, because both sensors simultaneously activate their switches, thereby indicating that the top sheets in the stack are simultaneously offset in both the left and right directions, a condition to which the corrective system cannot respond. On the other hand, if the two sensors are set somewhat too far from each other, the negative-feedback corrective system ceases to be useful for its intended purpose.

SUMMARY OF THE INVENTION

It is a general object of the invention to overcome the difficulties set forth above.

It is a more specific object to provide a very simple and inexpensive offset-correction system which, although set in dependence upon sheet format and very precise in its operation, does not place stringent demands upon precise setting of the position of the sensing means, nor upon the condition which the fresh stack must have if it is not to interfere with or render inoperative the sensing means of the system.

It is another object of the invention to provide a system capable of correcting offset in the top sheets of the stack continually, i.e., during continual sheet feeding, in such a way that a tall stack whose side faces are very convex, concave or wavy present the system with no particular difficulties, and furthermore such that the system will operate correctly even if the stack is laid on the elevator with a very great amount of transverse offset.

These objects, and others which will become more understandable from the description of a preferred embodiment, can be met, according to one concept of the invention, by utilizing sensing means, operative for sensing the position of the top sheets of the stack, located at only one side of the stack and, although located at only one side, operative for detecting transverse offset in both directions.

Because the sensing means is located at only one side of the stack, the stack can be laid in with even a great amount of offset, in the direction from the sensing means towards the stack, without interfering with the corrective action of the negative-feedback system in that situation, and certainly without damaging or interfering with the (prior-art) sensor located at the other side of the stack.

It is additionally contemplated that the sensing means be so designed that, if the stack is laid in greatly offset, in the direction from the stack towards the sensing means, the top face of the raised stack is detected by the sensing means, and the sensing means generate a simple signal indicative of offset in this direction, just as though the offset in this direction were of a very limited amount.

Accordingly, this concept makes it possible for tall stacks having markedly non-flat (convex, concave or wavy) side faces to be laid onto the elevator and processed by the system. Furthermore, even if the stack is laid in very poorly, with a great amount of offset, the system operates in its intended manner.

Because the system is capable of handling large-offset situations, the stack elevator, which is transversely shifted automatically to correct for such offset, may achieve a greatly non-centered position, by the time feeding of the stack is finished and the elevator is lowered for the laying in a further stack.

Accordingly, the invention additionally contemplates that the stack elevator, during its descent, be automatically brought to a centered position, so as not to confuse the operator when he lays in the next stack, and/or so as not to interfere with other components of the sheet feeding unit, such as side guide stops used by the operator when laying in the stack.

Additionally, the inventive system is so designed as to permit use of a non-stop or leap-frog elevator system. In such a system, when the stack has been partly exhausted, the weight of the stack is transferred to auxiliary stack supporting means, and the top of the stack remainder continues to be maintained at infeed height for continued sheet infeed, whereas the elevator descends empty for the laying in of a fresh stack, which is then raised up to mate with the bottom of the still elevated stack remainder. The present invention provides a system which can be used to transversely shift the elevator in a way not interfering with the operation of the auxiliary stack supporting means, and vice versa.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawings.

BRIEF DESCRIPTION OF THE DRAWINGS

FIG. 2 is a larger-scale view of the detail denoted II in FIG. 1, and likewise a section taken along line II—II of FIG. 6, showing an embodiment of the invention sensor, the sensor being shown in the position which it assumes when the top sheets of the stack are not excessively offset either leftward or rightward;

FIG. 3 is a view showing part of the same structure depicted in FIG. 2, but in the position which is assumes when the top sheets of the stack are offset too far leftward;

FIG. 4 is a view corresponding to FIG. 3, but showing the situation where the top sheets are offset too far rightward;

FIG. 5 is a view corresponding to FIG. 3, but showing the situation where the top sheets are offset so far rightward that the top face of the stack hits the sensor from below and lifts it;

DESCRIPTION OF THE PREFERRED EMBODIMENTS

Figure 1:
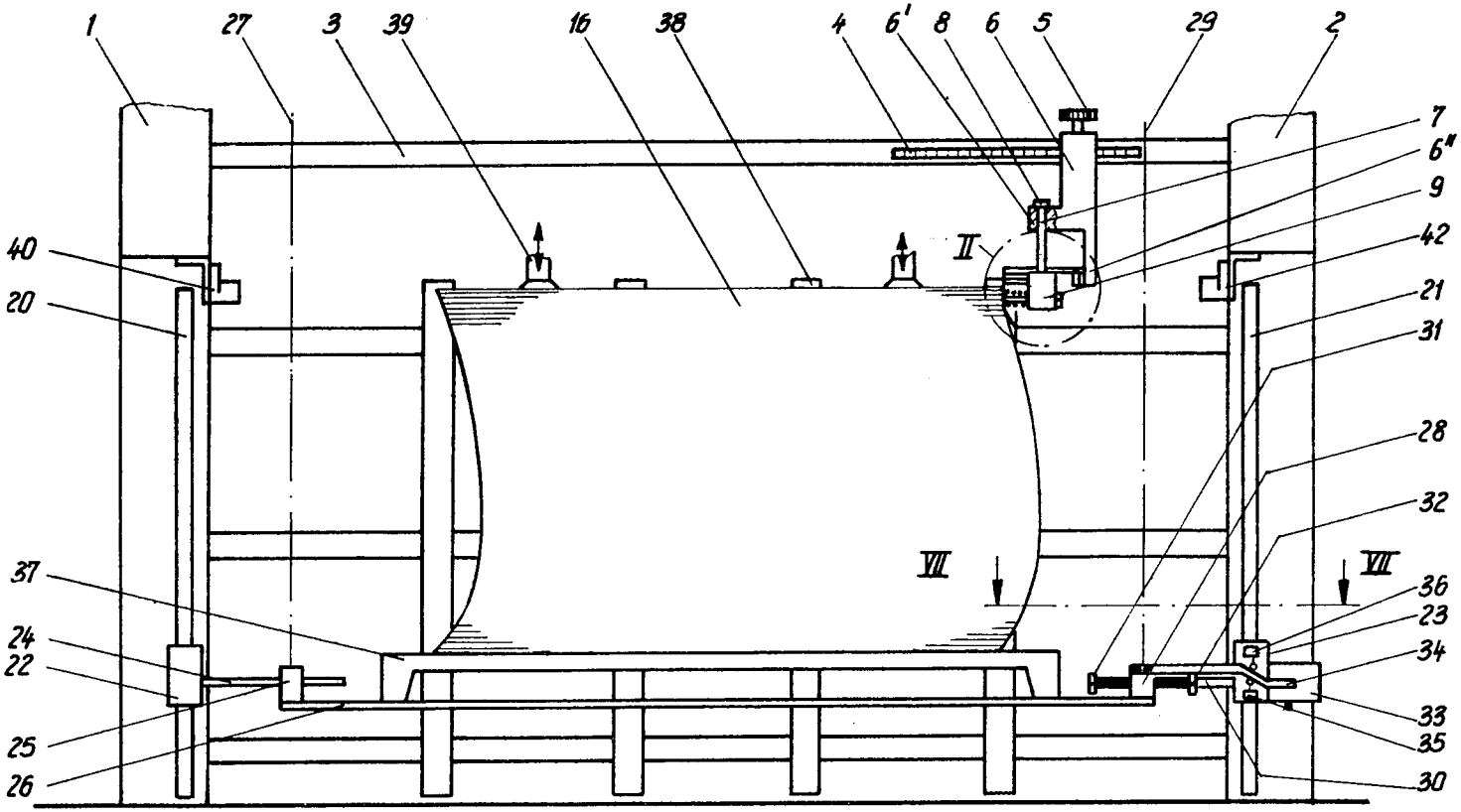
FIG. 1 is a schematic simplified front view of a sheet feeding unit, the stack of sheets therein being located intermediate the viewer and the machine into which the sheets are to be fed, the left and right side faces of the stack being respectively markedly concave and convex.
Figure 7:
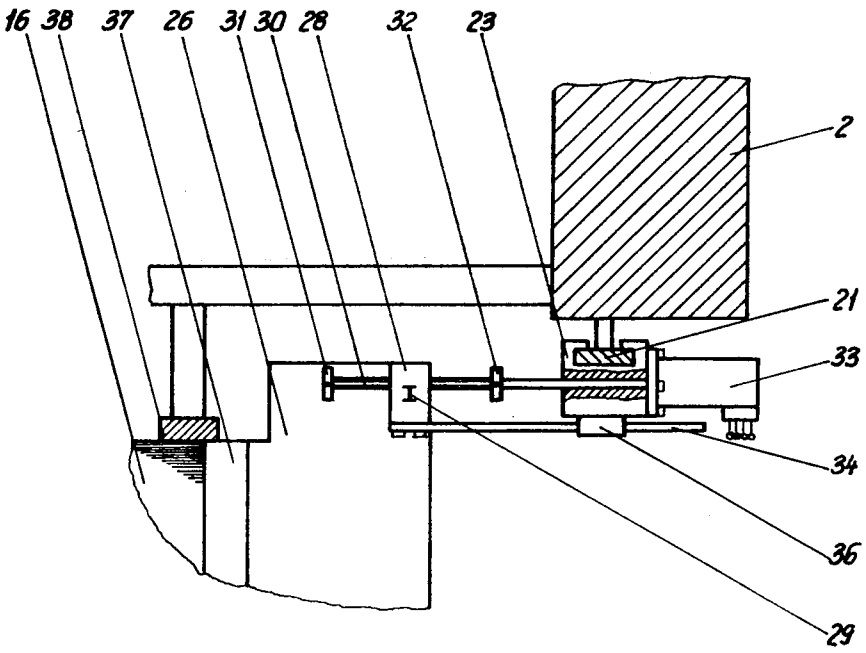
FIG. 7 is a section taken along line VII—VII of FIG. 1.

As shown in FIG. 1, the illustrated sheet feeder has two side walls 1, 2 connected by a traverse 3. Traverse 3 is provided with a calibrated format scale 4. A mounting structure 6 is shiftably borne by the traverse 3 and is shiftable lengthwise of traverse 3. Mounting structure 6 is provided with a lock screw 5 which is loosened when the mounting structure 6 is to be shifted for a different sheet format, and then tightened again when mounting structure 6 has been shifted to a position corresponding to the sheet format involved.

Figure 6:
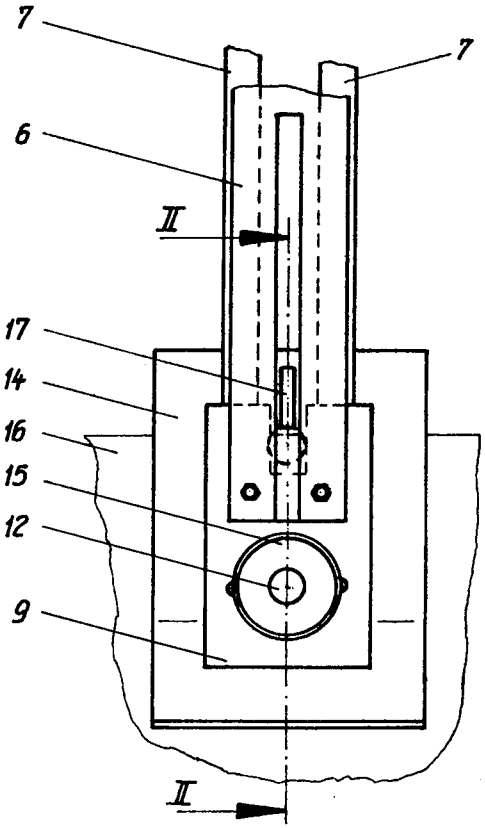
FIG. 6 is a view of the sensor, as seen in the direction of arrow VI in FIG. 2.

Mounting structure 6, as clearly seen in FIG. 1, has a leftwardly extending arm 6'. Two vertical bores within arm 6' receive respective ones of two carrier rods 7; in FIG. 1, the carrier rods 7 are arranged one behind the other and therefore only one is visible. The carrier rods 7 are provided at their tops with set collars 8, which support them on the arm 6'. Rigidly secured to the lower ends of the carrier arms 7, and dependently carried by arms 7, is a block 9. The encircled detail II in FIG. 1 is shown, on a much larger scale, in FIG. 2. As can be seen in FIG. 2, the upper end of block 9 is bifurcated and provided with a central left-to-right-going upwardly open slot 10. An upper bolt 11 is guided by this slot 10 and can move longitudinally through the slot 10. Block 9, as clearly shown in FIG. 2, is also provided with a horizontal bore which receives a lower bolt 12. Bolt 12 is guided by this horizontal bore and can slide through it left and right. Leftward travel of belt 12 throgh guide block 9 is limited by head 15 at the right end of bolt 12. The bolt 12 at its left end carries a compression spring 13. The right end of compression spring 13 is braced against a recess in the guide block 9. The left end of compression spring 13 is braced against a feeler 14. Compression spring 13 biases feeler 14 leftwards as viewed in FIG. 2 (see also FIG. 1) into engagement against the side of a stack of sheets 16. A control plate 17 is at its left end rigidly secured to the feeler 14, and shares the horizontal movement of feeler 14. As can be seen in FIG. 6, control plate 17 travels through the space intermediate the two carrier rods 7. As viewed in FIG. 2, the right end of control plate 17 is enlarged. As shown in FIG. 1, mounting structure 6 has a downwardly extending projection with a lower end 6''. As shown in FIG. 2, the lower end 6'' of this projection carries two inductive switches 18, 19 (discussed further below). The enlarged right end of control plate 17 (see FIG. 2) cooperates with inductive switches 18, 19 to trigger different control signals, depending upon the position of control plate 17 relative to inductive switches 18, 19. The longitudinal position of control plate 17 (as viewed in FIG. 2) depends upon the position of the feeler 14, biased against the right side of stack 16, relative to the mounting structure 6.

The sensor, comprised of feeler 14 and control plate 17, is vertically shiftable, relative to mounting structure 6, because the carrier rods 7 to which block 9 is rigidly secured are vertically shiftable in the guide bores in arm 6' (see FIG. 1). However, the sensor is not rotatable about a vertical axis. Likewise, the sensor is horizontally shiftable, relative to the block 9 and therefore relative to the mounting structure 6, because its guide bolts 11 and 12 are horizontally shiftable within carrier block 9. However, here again, the sensor is not rotatable about a horizontal axis.

Typically, the structure 6 (see FIG. 1), transversely shiftable along the format scale 4, is coupled to and controls the positions of two transverse aligning stops, used to at least roughly preposition the sides of the stack, depending upon the sheet format (size) involved. For example, when the structure 6 is shifted from a larger-format to a smaller-format setting, if the (non-illustrated) left aligning stop moves rightward to preposition the left sides of sheets in a stack, the such left sides should be located spaced from the left aligning stop a distance no greater than the rightward distance which the left aligning stop moves. The same applies when the (non-illustrated) right aligning stop moves leftward to preposition the right sides of sheets in a stack. The format scale 4 can, for example, be designed to include two different format-scale ranges.

Mounted on the side walls 1, 2 (see FIG. 1) are guide rails 20, 21. Surrounding and riding on the guide rails 20, 21 are respective guide blocks 22, 23. Rigidly secured to the guide block 22 is a rod 24 which, through the intermediary of a block 25, guides the stack elevator 26. Secured to guide block 22 is the end of one of the two left lift cables 27 for the stack elevator 26. Secured to the right side of elevator 26 is a further guide block 28, identical to guide block 22, but serving as a follower. Secured to right guide block 28 is the end of one of the two right lift cables 29 for the stack elevator 26. The elevator 26 is lifted by four lift cables one at each of its corners. Guide block 28 is provided with an internal horizontal threaded bore which receives an externally threaded spindle 30. Spindle 30 is provided at its two ends with set collars 31, 32 to limit its longitudinal movement through guide block 28. Spindle 30 is coupled to a positioning motor 33, preferably a one-phase A.C. rotating-stator-field motor. Positioning motor 33 is mounted on the guide block 23, and thus is shiftable with the latter along the length of guide rail 21. Guide block 28 carries a switching arm 34 secured thereto. Depending upon the transverse position of the stack elevator 26, and therefore depending upon the position of guide block 28, switching arm 34 can activate one or the other of two switches 35, 36.

Figure 8:
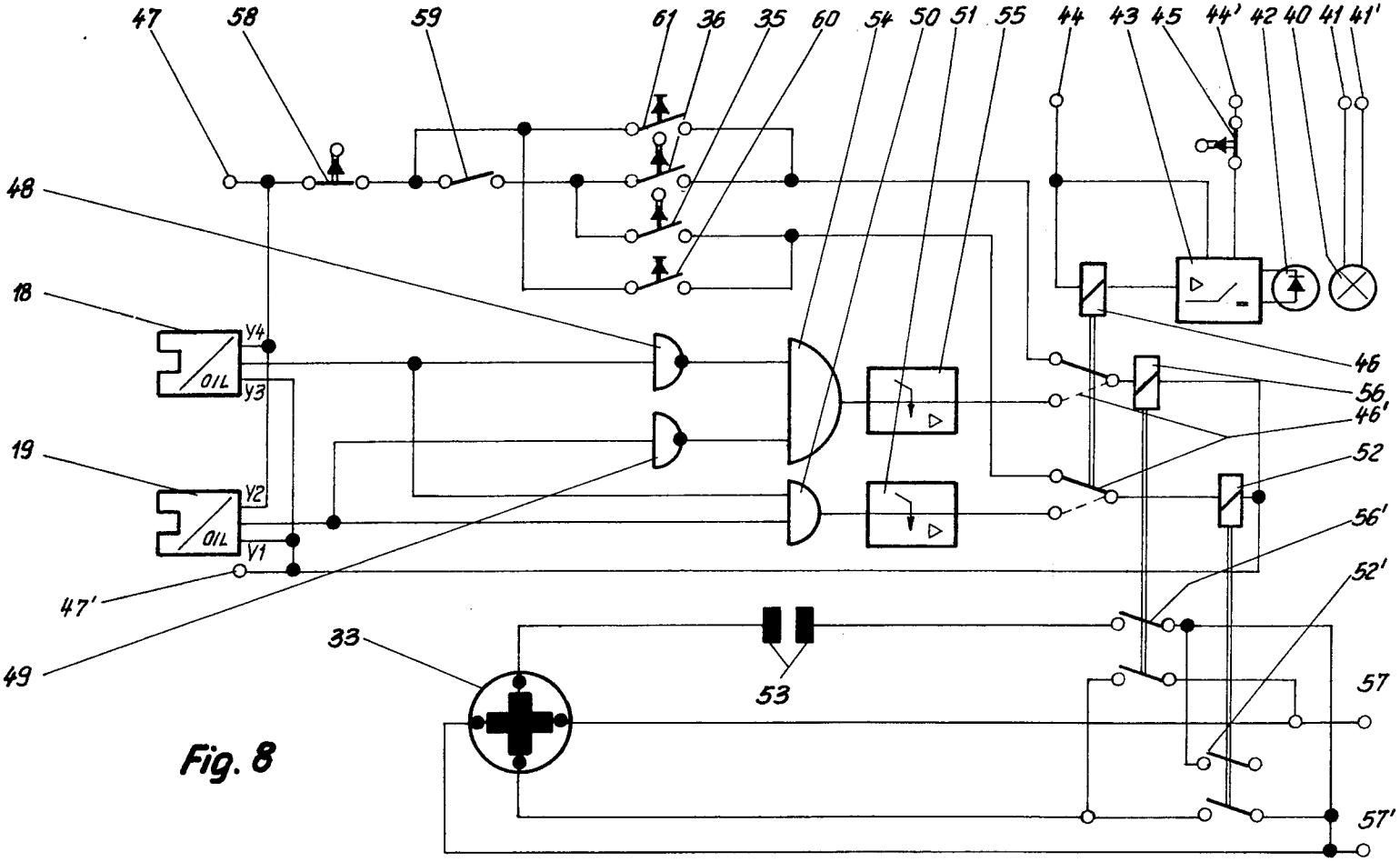
FIG. 8 is a block circuit diagram of the control system with which the illustrated sensor cooperates.

The stack of sheets 16 sits on a stack pallette 37. When inserting the stack on the pallette into the feeder, the stack 16 is moved forwards towards the printing or other such machine (in the direction away from the viewer in FIG. 1), until the front vertical face of the stack lies against the front vertical stop (positioning) rails 38 of the feeder. The feeder is provided with conventional suction-action sheet-removing elements 39. At the height of the latter, the feeder is provided on its left side wall 1 with a light source 40, and on its right side wall 2 with a light detector 42. Light source 40 is shown in the circuit diagram of FIG. 8 and receives D.C. operating voltage at 41, 41'; light detector 42 is shown in FIG. 8 as a photodiode connected to the input of an amplifier 43 which receives D.C. operating voltage at 44, 44'.

Connected in one of the D.C. voltage-supply lines for amplifier 43 is a limit switch 45. Limit switch 45 can be activated by the (non-illustrated) auxiliary stack supporting means of a non-stop system, if the feeder is provided with a non-stop system. This possibility is discussed further below, and for the purpose of explanation, it can meanwhile be assumed that limit switch 45 is permanently closed.

A relay winding 46, when energized, moves associated relay switches 46' to their lower settings (shown in broken lines); this occurs when the top of the stack 16 interrupts the light path between the light source 40 and the photodiode 42. When that occurs, control of the operation of the positioning motor 33 is taken over by the inductive switches 18, 19, which cooperate with the control plate 17. The inductive switches 18, 19 receive D.C. operating voltage at 47, 47'. One input of inductive switch 18 is connected directly to the upper input of an AND-gate 50 and also, via an inverter 48, to the upper input of an AND-gate 54; one output of inductive switch 18 is connected directly to the lower input of AND-gate 50 and also, via an inverter 49, the lower input of AND-gate 54. The output signal of AND-gate 50 is applied to a power-amplifier stage 51. The output voltage of power-amplifier stage 51 is transmitted, via lower relay switch 46' (when the latter is in its broken-line setting), to a relay winding 52. When relay winding 52 becomes energized, its associated relay contacts 52' close, and positioning motor 33 becomes connected to A.C. operating voltage at 57, 57', for operation in the first of its two rotary directions. In order that the one-phase A.C. motor 33 have a rotating stator field, one of its current supply lines contains a conventional 90°-phase-shift capacitor 53.

The output signals of the two inverters 48, 49 are evaluated by an AND-gate 54. The output signal of AND-gate 54 is transmitted to a power-amplifier stage 55. The output voltage of power-amplifier stage 55 is transmitted, via the upper relay switch 46' (when the latter is in its broken-line setting), to a relay winding 56. When relay winding 56 is energized, its associated relay contacts 56' close, connecting the positioning motor 33 for operation in the other of its two rotary directions.

In the current path to which D.C. operating voltage is applied at 47, 47', there is included a limit switch 58. Limit switch 58 is open when the stack elevator 26 is in its lowermost position; otherwise, limit switch 58 is closed.

The illustrated circuit furthermore includes a self-holding contact 59, two manually activated pushbutton switches 60, 61 and the two limit switches 35, 36. As can be seen in FIG. 8, the right ends of switches 60, 61 are connectable to the remainder of the illustrated circuitry, only via the relay switches 46', and are in fact connected to the remainder of the circuitry only when relay switches 46' are in their illustrated (solid-line settings), i.e., with relay winding 46 not energized. As will also be clear, relay winding 46 is energized only when the top of the stack 16 interrupts the light path between light source 40 and light detector 42. Thus, switches 60, 61 can have an effect upon the circuit, only when the top of the stack 16 is not interrupting the light path between light source 40 and photodiode 42. In this situation, manual depression of pushbutton switch 60 energizes relay winding 52, and thereby connects positioning motor 33 for operation in one rotary direction; likewise, manual depression of pushbutton switch 61 energizes relay winding 56, and thereby connects positioning motor 33 for operation in the opposite rotary direction.

The situation is similar for limit switches 35, 36. Like manual pushbutton switches 60, 61, limit switches 35, 36 can energize first-direction relay winding 52 or second-direction relay winding 56, only if relay winding 46 is unenergized, but with the further prerequisite that the self-holding contact 59 is closed; switches 60, 61 can energize windings 52 or 56, even when contact 59 is open. Self-holding contact 59 is in its closed setting in one situation only. When an elevator-descend command signal is manually or automatically generated, in per se conventional manner, the stack elevator 26 descends to its lowermost position, so that an operator can place a fresh stack, or additional sheets, into the feeder. During the course of this automatically commanded descent of the stack elevator 26, i.e., when subsequent to the descend command the stack elevator is actually in the process of descending, self-holding contact 59 is in its closed setting; otherwise, it is in its open setting.

The operation of the illustrated system is as follows:

The operator lays a stack of sheets 16 into the feeder, the stack elevator 26 being in its lowermost position at this time. Then, the operator for example presses a (non-illustrated) pushbutton switch, to manually command that the stack elevator rise. The stack elevator rises at high speed, bringing the top of the stack towards the suction-action infeed elements 39. As soon as the top of the stack 16 interrupts the light path between light source 40 and photodiode 42, relay winding 46 becomes energized and relay switches 46' assume their lower (broken-line) settings. This, now, makes it possible for the first-direction and second-direction relay windings 52, 56 to be controlled by the inductive switches 18, 19.

At this point, it may be that the part of the side of the stack 16 sensed by feeler 14, as shown in FIG. 2, is within the acceptable range of lateral displacement, i.e., not located too far to the left or too far to the right, as viewed in FIG. 2. In that event, as shown in FIG. 2, the enlarged right end portion of control plate 17 is located directly opposite inductive switch 19. Inductive switch 18 (see FIG. 8) produces an output "1" signal, and inductive switch 19 and output "0" signal. Accordingly, ANd-gate 50 is in receipt of a "0" signal at its upper input and a "1" signal at its lower input, does not produce an output "1" signal, and therefore does not energize first-direction relay winding 52. Likewise, AND-gate 54 is in receipt of a "1" signal at its upper input and a "0" signal at its lower input, does not produce an output "1" signal, and therefore does not energize second-direction relay winding 56. Accordingly, positioning motor 33 does not operate, and no corrective lateral displacement is initiated.

In contrast, it may be that, as shown in FIG. 3, the part of the side of stack 16 engaged by feeler 14 is located too far to the left. In that event, the enlarged right end of control plate 17 is located opposite both inductive switches 18, 19, and both these switches generate output "0" signals. Accordingly, AND-gate 50 (FIG. 8) receives "0" signals at both its inputs, and does not energize first-direction relay winding 52. In contrast, AND-gate 54 receives "1" signals at both its inputs, and does not energize second-direction relay winding 56. The positioning motor 33 begins to turn in its second rotary direction, driving the screw spindle 30 (FIG. 1), and shifting the stack elevator 26 rightwards, until the situation depicted in FIG. 2 is reached, whereupon the positioning motor 33 ceases to operate.

Likewise, it be that, as shown in FIG. 4, the part of the side of stack 16 engaged by feeler 14 is located too far to the right. In that event, the enlarged right end of control plate 17 is located opposite neither one of the two inductive switches 18, 19, and both these switches generate output "1" signals. Accordingly, AND-gate 54 is in receipt of "0" signals at both its inputs, and does not energize second-direction relay winding 56. In contrast, AND-gate 50 is in receipt of "1" signals at both its inputs, and does energize first-direction relay winding 52. The positioning motor 33 begins to turn in its first rotary direction, driving the screw spindle 30 (FIG. 1), and shifting the stack elevator 26 leftwards, until the situation depicted in FIG. 2 is reached, whereupon the positioning motor 33 ceases to operate.

FIG. 5 depicts a situation which results in the same corrective action as just described with respect to the situation depicted in FIG. 4, but for the case where the too-far-right location of the upper part of stack 16 is very extreme. As shown in FIG. 2, the bottom part of feeler 14 is downwardly and rightwardly inclined. When the top of a newly inserted stack is raised to operative height, if the top part of the stack is located only somewhat too far to the right, then the right top edge of the stack will slide along the inclined lower part of feeler 14 during elevator ascent. In so doing, the right top edge portion of stack 16 will displace feeler 14 horizontally rightwards (feeler 14 is not capable of tilting movement), and depending upon the force of compression spring 13, the feeler 14 may also cause the sheets of the top part of the stack to be pushed leftward, to some extent, resulting in either the FIG. 2 situation or else the FIG. 4 situation. However, if the top part of a newly inserted stack, during its rise to operative height, is located much too far to the right, then the upper horizontal face of the stack will engage the bottom edge of the inclined bottom part of feeler 14 from below. Accordingly, during completion of the rise to operative height, the top face of the stack will raise the entire structure 14, 17, 13, 12, 11, 9, 7, as a whole, vertically upwards. What results will be the situation depicted in FIG. 5. Of course, in terms of the output signals from inductive switches 18, 19, the FIG. 5 situation is the same as that in FIG. 4, and the positioning motor 33 will correctively shift the stack elevator 26 leftward, and if it overshoots too far leftward then thereafter also rightward, but in any event such that the FIG. 2 situation is finally reached.

The sheet feeding unit is provided with a conventional (non-illustrated) system which is operative, as sheets are removed from the top of the stack and fed to the printing machine, for continually raising the stack, in order to keep the top of the stack at substantially constant height. During continual sheet infeed, the top of the stack will be interrupting the light path between light source 40 and light detector 42, and accordingly the negative-feedback transverse shifting action described above will occur, if needed, during continual sheet feeding. Thus, even if (as shown in FIG. 1) one side face of the stack is markedly convex and the other markedly concave, the negative-feedback transverse shifting of the stack elevator 26 will continually assure that the sheets at the top of the stack are not located too far to the left or right.

After a considerable number of sheets have been fed off the stack and further sheets must be laid into the feeder, an elevator-descend command signal is automatically or manually generated, and the elevator 26 is caused (by conventional, non-illustrated means) to descend to its lowermost position. If the sheet feeding unit is of the type not provided with a non-stop or leap-frog arrangement (discussed further below), the elevator 26, carrying the pallet 37 and any remaining sheets still on the pallet 37, descends. When this descent begins, the light path between light source 40 and light detector 42 ceases to be interrupted. As a result, the relay winding 46 (FIG. 8) becomes deenergized; this makes it impossible for inductive switches 18, 19 to have any further effect upon the transverse position of the elevator 26.

As indicated earlier, switch 59 is closed during, and only during, the actual course of elevator descent. Thus, during elevator descent, switch 59 is closed, and it is now limit switches 35 and 36 which are connected for control of the leftward and rightward positioning of stack elevator 26. As shown in FIG. 1, the limit switches 35, 36 are activated by the switching arm 34, the left end of which is mounted on elevator 26. If the lateral position of elevator 26 is exactly centered, as shown in FIG. 1, then switching arm 34 activates neither one of the limit switches 35, 36; accordingly during elevator descent, the positioning motor 33 does not operate and does not change the position of the already centered elevator 26.

In contrast, in the course of the corrective action performed during stack raising, it may happen that, by the time elevator descent is commanded, the elevator 26 is considerably out of centered position. In that event, during elevator descent, switch arm 34 activates one or the other of limit switches 35, 36; positioning motor 33 operates in one or the other rotary direction; and elevator 26 is moved towards centered position. If the duration of the descent is long enough (e.g., because descent was commanded with an exhausted stack and therefore a high elevator level), then the elevator 26 will actually be brought to centered position by the time it reaches bottommost position and its descent terminates. If the duration of the descent is very short (e.g., because descent was commanded with a tall stack and therefore with the elevator already near its bottommost position), and/or if the elevator during its descent is in a greatly non-centered position, then the centering of the elevator 26 at the termination of descent may be incomplete. However, in either case, during elevator descent, the system attempts to center the elevator. Otherwise, the corrective action automatically performed during elevator ascent could gradually, e.g., over a long term, bring into being a greatly non-centered elevator position, which could confuse the operator when he lays fresh sheets onto the elevator.

When elevator descent is completed, self-holding contact 59 opens and the centering of the elevator, if not already finished, is stopped unfinished.

The foregoing explanation is clearly applicable to a sheet feeding unit not provided with a non-stop or leap-frog system. However, the use of non-stop systems is quite important in sheet feeders, and it is to be understood that the present invention is applicable when such a system is provided. A non-stop or leap-frog system is disclosed, for example, in our earlier U.S. Pat. No. 4,021,710, granted May 3, 1977, and entitled "Speed Control System for a Continuously Operating Sheet Feeder," the entire disclosure of which is incorporated herein by reference.

As shown in FIG. 1*a* of that patent, the stack pallet 2 is provided with grooves which can receive support rods 2'. Initially, i.e., as shown in FIG. 1*a* of that patent, the stack pallet and stack are supported by the stack elevator per se. When the stack is nearing exhaustion, than as shown in FIG. 1*c* of the patent the support rods 2' being to be borne by auxiliary stack supporting means 18, 19, and the elevator and stack pallet can descend, so that a fresh stack can be laid onto them. During the time that the remaining stack and support rods 2' are borne by auxiliary stack supporting means 18, 19, the auxiliary stack supporting means 18, 19 operates as the full functional equivalent of the stack elevator, i.e., it raises the stack remainder to maintain the top of the stack at approximately constant height. As shown in FIG. 1*e* of the patent, when a fresh stack is laid onto the stack pallet, the elevator, pallet and fresh stack are raised until the top of the fresh stack reaches the bottom of the remainder stack, after which the support bars 2' are pulled out and support of the remainder stack plus the fresh stack is taken over again by the stack elevator per se.

Limit switch 45 in FIG. 8 (thus far assumed to be permanently closed) is in fact activated by the auxiliary support means of a non-stop or leap-frog system, if such system is provided. If a leap-frog system is provided, and utilized, then of course during elevator descent the top of the stack remainder continues to be maintained at operative height, and therefore the light path of light source 40 and detector 42 continues to be interrupted; i.e., the mere fact of elevator descent does not disconnect the inductive switches 18, 19. It is for this reason that the limit switch 45 is used. Limit switch 45 is responsive to the bearing of weight by the auxiliary stack supporting means of the leap-frog system. When the guide bars are in place upon the auxiliary stack support means, and the elevator begins to descend, the auxiliary stack support means begins to bear the weight of the stack remainder above it, and this opens limit switch 45. As a result, relay winding 46 becomes deenergized, and inductive switches 18, 19 become disconnected from the circuit, so that limit switches 35, 36 can effect centering of the elevator during its descent, in the manner already described. After a fresh stack has been laid onto the lowered pallet and elevator, the elevator, pallet and fresh stack are raised, until they press upwardly against the support bars borne by the auxiliary stack supporting means, as a result of which the weight of the stack remainder is transferred back onto the elevator per se, and ceases to be borne by the auxiliary stack supporting means. When the auxiliary stack supporting means is thusly relieved, the limit switch 45 closes, the relay winding 46 becomes energized again, and the transverse positioning of the elevator is again taken over by the inductive switches 18, 19.

As the fresh stack on the pallet and elevator is being raised towards the bottom of the remainder stack, the operator may see that the fresh stack is greatly offset transversely relative to the remainder stack. This could result from the already described centering of the elevator during its descent, and/or from a sloppy laying of the fresh stack on the lowered elevator. If the operator sees that such a situation has occurred, then to prevent the mating of the top of the fresh stack to the bottom of a greatly offset remainder stack, the operator can press one or the other of pushbutton switches 60, 61 during elevator ascent, to prevent excessive offset between the mated remainder stack and fresh stack.

If a leap-frog system incorporating such auxiliary stack supporting means is utilized then, as already stated, during operation of the auxiliary stack supporting means the latter constitutes the full functional equivalent of the stack elevator per se. Accordingly, it is to be understood that the aforedescribed negative-feedback transverse shifting system for the elevator per se would have equal utility when applied to the auxiliary stack supporting means. Accordingly, for the purposes of the present invention, the auxiliary stack supporting means is to be considered an elevator, just as much as the stack elevator per se, and control of the transverse position of the auxiliary stack supporting means during the stack-raising occurring during continual feeding, and furthermore automatic centering of the auxiliary stack supporting means when the latter is relived of stack weight and descends to its starting position, are positively contemplated by the present invention, i.e., in a manner analogous to what has been described for the elevator per se.

It will be understood that each of the elements described above, or two or more together, may also find a useful application in other types of circuits and constructions differing from the types described above.

While the invention has been illustrated and described as embodied in a particular type of sheet feeding unit, it is not intended to be limited to the details shown, since various modifications and structural changes may be made without departing in any way from the spirit of the present invention.

Without further analysis, the foregoing will so fully reveal the gist of the present invention that others can by applying current knowledge readily adapt it for various applications without omitting features that, from the standpoint of prior art, fairly constitute essential characteristics of the generic or specific aspects of this invention.

What is claimed as new and desired to be protected by Letters Patent is set forth in the appended claims.

1. In a sheet feeding unit of the type including a stack elevator which raises the top of a stack of sheets to infeed height, in combination, sensing means located at only one side of a stack supported by the stack elevator and operative for detecting when the sheets at the top of the stack are properly positioned, are transversely offset too far to the left, and are transversely offset too far to the right, the sensing means including two proximity detector switches which are independently operable and which generate signals indicative of proper positioning, excessive rightward transverse offset and excessive leftward transverse offset, the sensing means further including movable feeler means physically engageable with top sheets in the stack at only one side of the stack and movable to respond to position of such top sheets to operate the proximity detector switches in accordance with such position, and the sensing means still further including means mounting the switch means and feeler means so as to enable the feeler means to be physically engageable with top sheets in the stack at only one side of the stack; and control means operative in response to said signals for automatically performing corrective transverse shifting of the stack elevator.

2. In a sheet feeding unit as defined in claim 1, the proximity detector switches being inductive proximity detector switches.

3. In a sheet feeding unit as defined in claim 1, the means mounting the feeler means mounting the latter for shifting movement in the direction of any transverse offset, the two proximity detector switches being located side by side in the direction of transverse offset, the combination of signals generated by the two switches when the feeler means moves adjacent to both switches indicating that the top sheets of the stack are improperly offset away from the feeler means towards the stack, the combination of signals generated by the two switches when the feeler means moves adjacent that one of the two switches which is located farther from the stack indicating that the top sheets of the stack are properly positioned, the combination of signals generated by the two switches when the feeler means moves from the stack towards the switches to a position away from both switches indicating that the top sheets of the stack are improperly offset from the stack towards the feeler means, the control means including logic circuit means operative for receiving signals generated by the two switches and discriminating between the signals generated by the switches.

4. In a sheet feeding unit as defined in claim 3, the logic circuit means including first and second AND-gates operative for producing at their respective outputs first-direction and second-direction command signals commanding that the stack elevator be shifted in a first and a second direction, one AND-gate having two inputs directly connected to the outputs of the two proximity detector switches, the other AND-gate having two inputs connected to the outputs of the two proximity detector switches through inverters.

5. In a sheet feeding unit as defined in claim 4, the control means furthermore including a positioning motor coupled to the stack elevator for transversely shifting the stack elevator, a motor-direction control circuit connected to the motor operative for determining the direction of motor operation and having inputs receiving first-direction and second-direction command signals, a relay winding and relay switches controlled by the relay winding, the relay switches having a first setting connecting the outputs of the first and second AND-gates to the inputs of the motor-direction control circuit and having a second setting, photoelectric height detecting means operative for causing the relay winding to move the relay switches to the first setting upon detection that the top of the stack is in the vicinity of the infeed height, first-direction and second-direction limit switches operative when activated for generating first-direction and second-direction command signals, these limit switches being connected to the inputs of the motor-direction control circuit via the two relay switches when the relay switches are in the second setting, and means operative for automatically activating either of the two limit switches depending upon leftward and rightward transverse displacement of the stack elevator relative to a predetermined centered position.

6. In a sheet feeding unit as defined in claim 5, the positioning motor being a one-phase rotating-statorfield A.C. motor.

7. In a sheet feeding unit as defined in claim 1, the stack elevator being provided with an internally threaded structure, the control means including a positioning motor and an externally threaded drive spindle received in said structure and driven by the positioning motor to transversely shift the stack elevator.

8. In a sheet feeding unit as defined in claim 1, the control means including height-detecting means generating an enablement signal when the height of the top of the stack is near infeed height, and means operative for preventing stack-offsetdependent corrective shifting of the elevator except during generation of the enablement signal.

9. In a sheet feeding unit as defined in claim 1, the control means including means operative during elevator descent for automatically shifting the stack elevator to a predetermined centered position.

10. In a sheet feeding unit as defined in claim 1, the means mounting the feeler means mounting the feeler means for horizontal shifting movement and for vertical displacement, the two proximity detector switches being transversely located side by side in direction of any transverse offset, the feeler means moving in dependence upon the direction and magnitude of any tranverse offset to positions in the operative vicinity of different proximity detector switches and when the offset is in the direction from the stack towards the switches to a position in the operative vicinity of none of the switches, the mounting means furthermore including biasing means biasing the feeler means away from the switches and towards the stack, the feeler means comprising a feeler structure having a downwardly extending camming surface inclined in the direction away from the stack, whereby if the stack is transversely offset from the stack towards the switches by a limited amount the top edge of the stack engages the camming surface and displaces the feeler structure horizontally in the direction towards the switches and away from their operative vicinities, and whereby if the stack is transversely offset from the stack towards the switches by an amount greater than this limited amount the top face of the stack engages the feeler structure from below and displaces the feeler structure vertically away from the operative vicinity of the switches.

11. In a sheet feeding unit as defined in claim 1, the means mounting the feeler means including a mounting block having two horizontal guide passages and two guide bolts received in the guide passages, the feeler means including a feeler structure secured to the two guide bolts for horizontal shifting movement, a compression spring surrounding one of the guide bolts and braced between the feeler structure and the mounting block to urge the feeler structure towards the stack, and a stop on said one of the guide bolts for limiting the extent to which the feeler structure can move towards the stack, the feeler structure having a downwardly extending camming surface inclined away from the stack.

12. In a sheet feeding unit as defined in claim 1, the means mounting the feeler means including a holding structure mounted for transverse shifting movement to different settings for different sheet formats, the holding structure having a transverse arm provided with two vertical guide passages, two carrier rods received in the two vertical guide passages and depending from said arm, the feeler means being secured to the two carrier rods, the proximity detector switch means being secured to a bottom end of the holding structure.

* * * * *